United States Patent [19]

Scott

[11] 4,378,180

[45] Mar. 29, 1983

[54] YIELDABLE MINE ROOF SUPPORT FIXTURE

[76] Inventor: James J. Scott, Lecoma Star Rte., Rolla, Mo. 65401

[21] Appl. No.: 204,090

[22] Filed: Nov. 5, 1980

[51] Int. Cl.[3] ..... E21D 21/02

[52] U.S. Cl. ..... 405/259; 411/8

[58] Field of Search ..... 405/259, 260, 261; 411/8, 24, 26

[56] References Cited

U.S. PATENT DOCUMENTS

| | | | |
|---|---|---|---|
| 1,038,834 | 9/1912 | Bloom | 411/24 |
| 2,725,843 | 12/1955 | Koski | 116/114 |
| 2,850,937 | 9/1958 | Ralston | 85/62 |
| 2,943,528 | 4/1960 | Curry | 85/62 |
| 2,947,279 | 8/1960 | Hohos et al. | 116/208 |
| 3,161,174 | 12/1964 | Harrison | 116/114 |
| 3,226,934 | 1/1966 | Emery | 405/259 |
| 3,478,523 | 11/1969 | Reusser et al. | 61/45 |
| 3,693,359 | 9/1972 | Karara | 61/45 B |
| 3,797,254 | 3/1974 | Askey et al. | 405/259 |

FOREIGN PATENT DOCUMENTS

| | | | |
|---|---|---|---|
| 964942 | 3/1975 | Canada | 411/8 |
| 1192635 | 10/1959 | France | 405/259 |
| 2422140 | 12/1979 | France | 405/259 |

*Primary Examiner*—David H. Corbin

*Attorney, Agent, or Firm*—Gravely, Lieder & Woodruff

[57] ABSTRACT

A yieldable mine roof support fixture in which a support member is anchored in a borehole in the geologic mass and is formed with a divergent tapering end adjacent the mine roof which cooperates with a support plate having an opening engaged with the tapering end and yieldable so as to allow the plate to slide or move along the tapering end for imposing resistance to movement of the geologic mass which varies from substantially constant to progressively increasing resistance.

8 Claims, 14 Drawing Figures

YIELDABLE MINE ROOF SUPPORT FIXTURE

BACKGROUND OF THE INVENTION

1. Field of the Invention

This invention is directed to roof support fixtures for underground passages in which the support fixture develops a controlled yield in response to movement of the surrounding material in which the passage has been created.

2. Description of the Prior Art

It is known that the creation of underground passages releases forces in the geologic mass which has been initially substantially in balance before the passage was formed. Means for resisting the forces to reestablish a balance so as to retard the movement of the geologic mass surrounding the passage have been proposed in several different forms.

An early form of roof bolt is disclosed in Ralston U.S. Pat. No. 2,850,937 of Sept. 9, 1958. In this disclosure, the roof bolt provides indicator means which can be seen and which conveys information regarding whether or not the roof bolt is supporting its desired load in a mine ceiling.

The disclosure by Reusser et al in U.S. Pat. No. 3,478,523 of Nov. 18, 1969 is directed to a load bearing plate for use in mine roof supports intended to cover relatively small or localized surfaces of the mine roof to stabilize the rock formation and prevent collapse thereof.

The Karara U.S. Pat. No. 3,693,359 of Sept. 26, 1972 is directed to rock stabilizing apparatus in which a tension member inserted in a hole and cemented therein carries a tapered wedge slidable on the tension member and held by a threaded element.

The prior art includes devices for visually indicating the movement of the roof in mine passages, such art being exemplified by Koski U.S. Pat. No. 2,725,843 of Dec. 6, 1955; Curry U.S. Pat. No. 2,943,528 of July 5, 1960; Hohos et al U.S. Pat. No. 2,947,279 of Aug. 2, 1960; and Harrison U.S. Pat. No. 3,161,174 of Dec. 15, 1964.

SUMMARY OF THE INVENTION

The present roof support fixture is directed to overcoming the problems connected with allowing mine roof structure to yield under controlled conditions so that the mine can be worked with reasonable safety to personnel. In the formation of an underground passage, the roof arch is the strongest load carrying member and far exceeds the strength of any individual support fixture. Consequently, roof support fixtures need to be located to preserve the strength of the roof arch as much as possible. The characteristics of the geologic mass in which a mine passage is formed have a bearing on the type and structure of the roof support fixture needed to control the geologic mass reaction to the creation of a passage.

It is, therefore, a principal object of the invention to provide a mine roof support fixture which can be used in passages formed in salt or shale mining, in hard rock formations, and in mud stone or gypsum mining, or other geologic materials and one capable of yielding to the movement of the geologic mass at a controlled rate.

It is a further object of the present invention to provide a support fixture in which the anchor member to be secured in a borehole in the mine roof provides a tapered surface for engaging and supporting the plate against the geologic mass such that the plate can yield as the geologic mass reacts to the forming of the passage, while the anchor for supporting the plate remains in place.

A further object of the present invention is to provide a roof engaging plate with a prepared opening for movement alone a cone shaped or tapering surface on a support member anchored in the mine roof, such movement of the plate taking place under a load less than the ultimate strength of the fixture.

Still another object of this invention is to provide a yieldable mine roof support fixture in which a support member anchored by one end in the geologic mass has resistance means on the opposite end providing a surface which from its zone of origin expands circumferentially as it extends along the support member away from the zone of origin, and a support plate mounted on the resistance means initially close to the zone of origin and movable along the resistance means to yield to load from the geologic mass, whereby the resistance means and the support plate impose a substantially constant or a progressively increasing resistance to movement of the geologic mass.

The present support fixture is exemplified in a preferred embodiment in which the support member to be inserted in a borehole may be a reinforcing bar, a cable, a rod, a bolt or a tube having tensile strength of an order to accommodate the stress expected from movement or reaction in the geologic mass. The support member is provided at its end adjacent the roof with a tapered surface resistance means which is engaged by a hole formed in a roof support plate such that the plate may slide on the engaged surface to develop a substantially constant or a progressively increasing resistance to the roof load imposed on the plate.

BRIEF DESCRIPTION OF THE DRAWINGS

Certain preferred embodiments of the present invention are shown in the accompanying drawings, wherein.

DETAILED DESCRIPTION OF THE EMBODIMENTS

Figure 1:
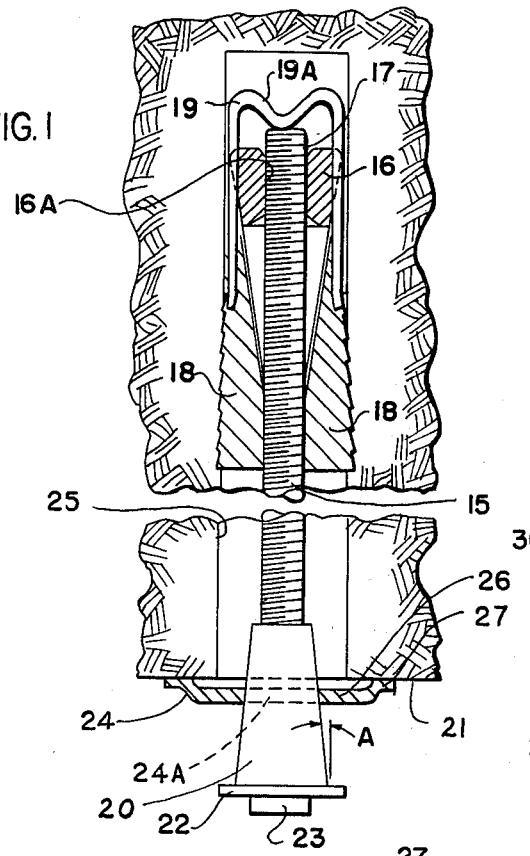
FIG. 1 is an embodiment of a roof bolt having a mechanical anchor in the blind end of the borehole and an opposite end formed with a tapered configuration engaged by an embossed roof plate at the exposed roof surface.
Figure 2:
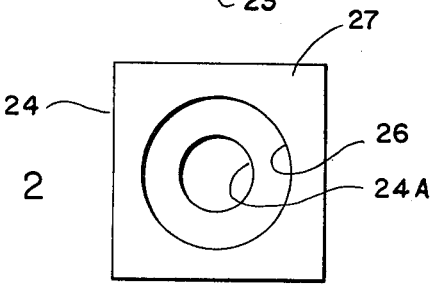
FIG. 2 is a plan view of the embossed roof plate seen in FIG. 1.

FIGS. 1 and 2 illustrate a support fixture in which the support member is a bolt 15 anchored in a mine roof by a mechanical anchor which includes a wedge 16 carried on the threaded end 17 of the bolt. The wedge 16 is enclosed in a pair of half circle anchor sleeves 18 which are loosely retained on the wedge 16 by a bail 19 which has its closed end 19A passed over the threaded opening 16A in the wedge 16. The opposite end of the bolt 15 carries a resistance means in the form of a tapered formation 20 which is exposed at the roof surface 21 in the mine passage. The formation is adjacent a flange 22, and a wrench head 23 is provided below the flange 22 for engagement by a suitable driving tool.

Before the mechanical anchor is mounted on the bolt, a support plate 24 is positioned on the tapered formation 20. The anchor is threaded on the end 17 of the bolt 15 and the assembled fixture is inserted in the borehole 25 until the plate 24 is flush against the roof surface 21. Upon turning the bolt 15 by its wrench head 23, the wedge is drawn down on the end 17 and the anchor sleeves 18 are expanded into gripping contact with the borehole 25. The length of the bolt 15 may vary from about two to twenty feet, while the borehole should be deeper so the anchor can perform its function. The length of bolt in the fixture is dependent in most cases upon the character of the geologic mass in which the passage is formed.

Figure 14:
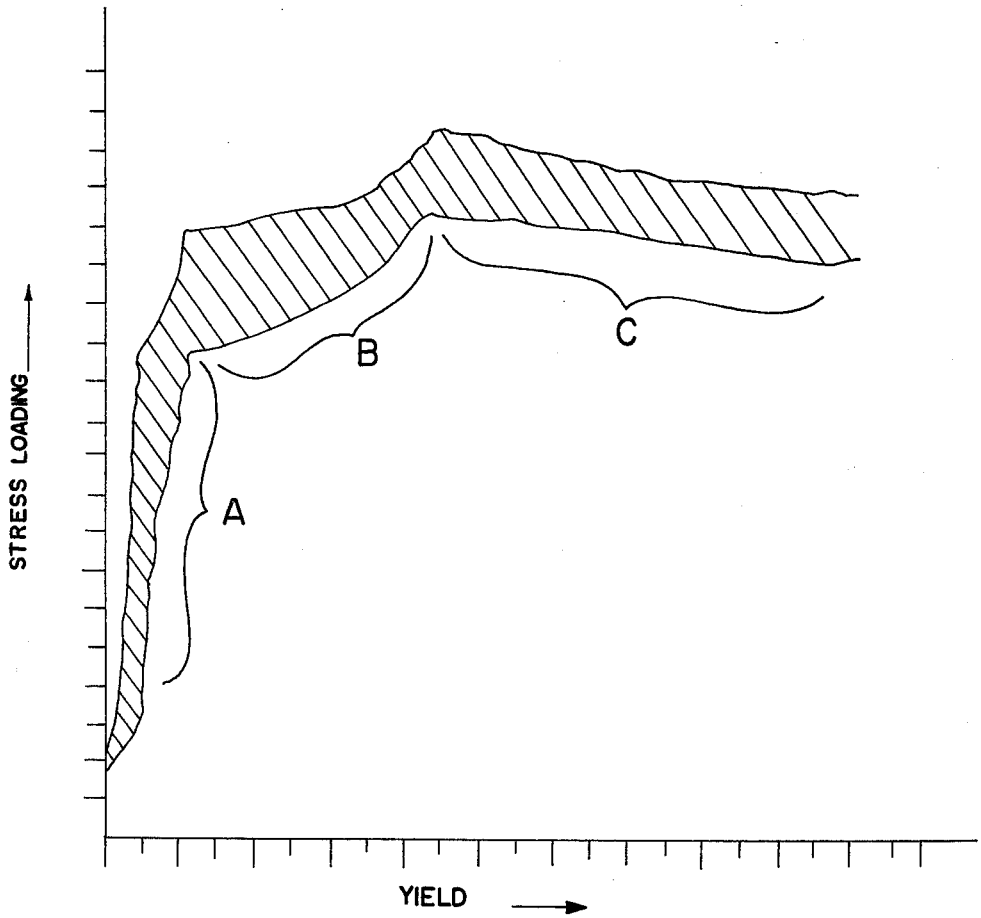
FIG. 14 is a chart showing a load-yield relationship for a family of roof support fixtures which include characteristics of the fixtures shown in the preceding drawing views.

The purpose for fixtures of the foregoing character is to control the yield in the geologic mass as soon after the formation of the passage as possible. The initial installation is carried out so the plate 24 is relatively tight against the ceiling 21, and is also close to the small end or zone of origin of the tapered surface 20. As the geologic mass yields, the plate 24 is loaded and slips on the surface 20 of the resistance means for the purpose of causing the hole in the plate to fit the tapered surface 20. This initial slippage is illustrated in FIG. 14 to occur in the portion A of the load-yield graph. The yielding displacement of the plate 24 is not very great while the load imposed thereon increases rapidly. The portion B of the load-yield graph depicts the yielding of the plate on the tapered surface, and to some extent the elongation taking place in the bolt 15. The portion C of the load-yield graph illustrates the more rapid yield in the fixture in relation to variations from constant to a lesser rise or even reduction in the load from the geologic mass.

The plate 24 in FIGS. 1 and 2 has a central aperture 24A formed in the embossed area 26 which is offset from the base plane 27 of the plate 24. This embossment 26 adds stiffness to the plate so the plate can be formed from thinner material without sacrifice in its desired support function. The thickness may range from one hundred and twenty thousandths inches (0.120") to about four hundred and twenty thousandths (0.420").

In the form of the fixture seen in FIG. 1, a bolt 15 has been used in which the lower end portion may be upset so as to form an integral tapered portion 20, the tapering angle A of which may vary from as little as 1° to as much as 15°. The preferred range of angles is about 5° to 8°. It is important that the hole 24A in the plate 24 should fit on the tapered portion 20 near its small end so as to have a desirable length of relative slippage on the tapered portion 20 as the geologic mass expands in its usual reaction to the formation of a mine passage. It is to be understood that the tapered portion 20 may be circular, or oval, depending on the degree of load that is to be imposed on the plate 24 to cause it to slip along the tapered portion 20 without stressing the bolt 15 beyond approximately three-fourths of its ultimate stress.

Figure 3:
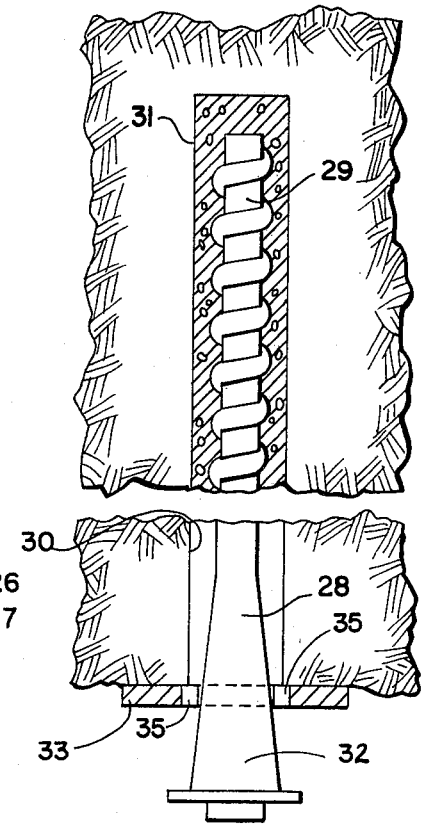
FIG. 3 is another embodiment of a roof reinforcing rod having its blind end secured in a resin or cementatious body and its opposite end formed with a tapered configuration to be engaged by a flawed roof plate.
Figure 4:
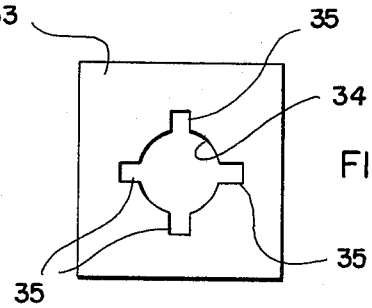
FIG. 4 is a plan view of the flawed roof plate seen in FIG. 3.

Turning now to FIGS. 3 and 4, a modified embodiment of the mine roof support fixture is illustrated in which the support member 28 may be selected from any of the available reinforcing bar stock such that the roughened surface portion 29 thereof is available to obtain a secure anchor in the borehole 30 by means of an anchoring material 31 which will set up and establish a firm anchorage for the member 28. The anchoring material may be cement or grout or a resin, any of which can be adapted to set up within a reasonable period of time. The exposed end portion of the member 28 may be shaped into a tapered configuration 32 for the reception of a support plate 33. As seen in FIG. 4, the support plate 33 is formed with a flawed hole 34 having notches 35 spaced around its periphery so as to interrupt the continuity of the periphery and thus allow the material adjacent the hole 34 to yield more readily as it slips on the tapered portion 32. The slippage occurs as the plate 33 adapts itself to the shape of the tapered portion which may be circular in cross-section or oval, or it may have some other progressively expanding configuration.

Figure 5:
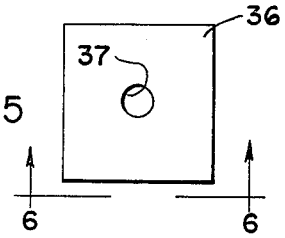
FIG. 5 is a plan view of a roof plate with a punched or stamped hole.
Figure 8:
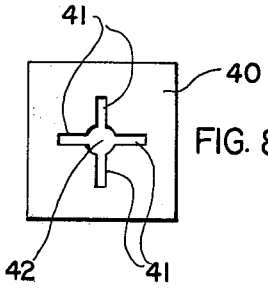
FIG. 8 is a modified flawed roof plate formed with radial slots.
Figure 6:
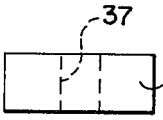
FIG. 6 is a side view taken at line 6—6 in FIG. 5.
Figure 7:
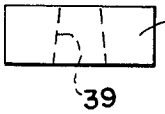
FIG. 7 is a roof plate modification in which a tapered hole is provided, usually by a grinding operation.
Figure 9:
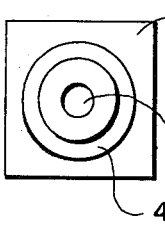
FIG. 9 is a further modified roof plate with an annular embossment.

The members 15 and 28 seen in FIGS. 1 and 3, respectively, may be utilized in association with a support plate 36 as seen in FIGS. 5 and 6 where the plate is substantially flat and is formed with a punched or stamped hole 37. If it is desired to have the support plate hole more nearly match the tapered or flared end of the anchor members 15 or 28, it may take the form of the plate 38 as seen in FIG. 7 which may have a tapered ground hole 39. An example of an alternate flawed support plate 40 is seen in FIG. 8 where slashes 41 have been formed to interrupt the continuity in the periphery of the hole 42. A still further modification for a support plate is shown in FIG. 9 where the plate 43 has a central aperture 44 spaced inwardly from a raised embossment 45 which increases the stiffness of the plate 43. The thickness of a material from which any of the support plates seen in FIGS. 2 and 4 through 9 is formed may vary in the range from 0.120" to 0.420". The support members 15 or 28 may be selected from suitable bar stock or tubular material which will accommodate threading as shown at 17 in FIG. 1, or surface roughening as seen at 29 in FIG. 3.

Figure 10:
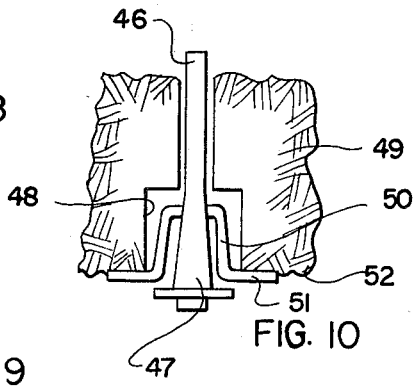
FIG. 10 is an embodiment showing a modified installation of a roof bolt in which the roof plate and conic section on the bolt are recessed in the roof to avoid projecting into the mine passage.

FIG. 10 illustrates a modified support fixture in which the upper end (not shown) may be securely anchored as suggested in FIGS. 1 or 3. The lower end of the member 46 has its tapered portion 47 positioned in a recess 48 formed in the geologic mass 49 so as to accommodate a type of fairly deep drawn support plate 50 which is slidably carried on the tapered portion 47 within the recess 48 and in which it provides an exposed flange portion 51 for engagement against the surface 52 of the geologic mass 49. This type of fixture is found desirable in mine passages where projection of the fixture needs to be eliminated.

Figure 11:
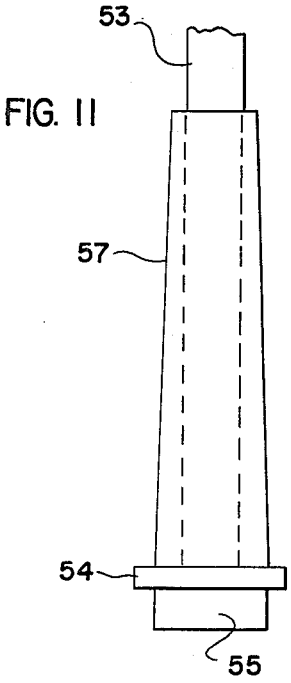
FIG. 11 is a roof bolt provided with a tapering sleeve which may be one-piece or split.
Figure 12:
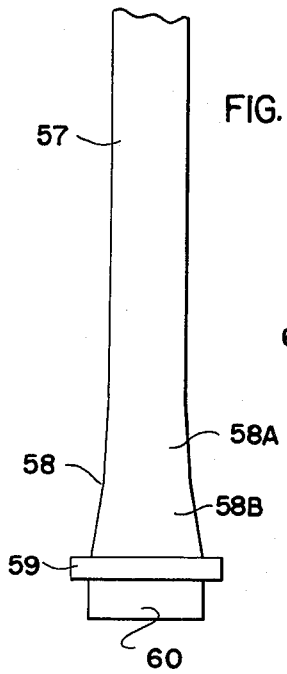
FIG. 12 is a roof bolt with a tapered-flared end.
Figure 13:
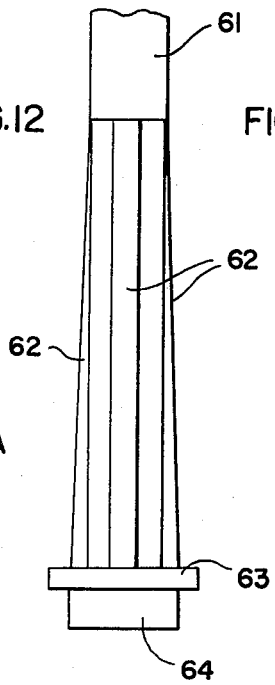
FIG. 13 is a modified roof bolt with tapering ribs spaced about the end thereof.

FIGS. 11, 12 and 13 illustrate modifications. In FIG. 11, the support member 53 is provided with a flange 54 and a wrench head 55 at its lower end. Instead of forming an integral tapered portion on the member 53, in this case, it is illustrated to be a tapered sleeve 56 which fits over the member 53 and is seated on the flange 54. The sleeve 56 may be formed in one piece or it may be formed in two or more pieces which would then require the placement of a support plate in order to hold them in assembled position. The support member 57, seen in FIG. 12, provides a flared end portion 58 which expands as it approaches the flange 59 at the wrench head 60. The flare may be formed by approximately a 5° taper portion 58*a* on top of approximately an 8° taper portion 58*b*, thereby accommodating a more rapid movement of the support plate in the early stages of its yielding and increasing resistance to movement in the later stages thereof. The support member 61 seen in FIG. 13 is provided with circumferential spaced wedge elements 62, the thickened ends of which terminate at flange 63 adjacent a wrench head 64.

In the foregoing description of the resistance means, reference has been made to tapering formations at the lower end of the anchored support members, and it is to be understood that the tapering formation may include regular cone configurations, oval configurations when seen in cross-section, or flared formations as illustrated in FIG. 12. The wedge elements of FIG. 13 would also fall within the intended definition for tapered formation.

It is also to be understood that the tapering formation may have a hardness characteristic so as to develop a desired yield relationship with any of the support plates, and that the support plates may either be formed from mild steel or from material of a hardness approaching equality with the hardness of the tapering formation. The working relationship between the support plate and the tapering formation is intended to develop a controlled yield or slippage of the plate along such a formation so as to yieldably resist the movement of the geologic mass, without reaching the ultimate strength of the fixture until the support plate has reached or has closely approached the flange formation which would prevent the support plate from further slippage and transfer the stress fully into the support member.

It should be obvious that modifications may come to mind from the foregoing disclosure of certain preferred embodiments of the present invention without departing from the intended spirit of the invention.

What is claimed is:

1. A yieldable mine support fixture for use in stabilizing the geologic mass of an underground passage, said fixture being disposed in a borehole and comprising: a support member having an end portion anchored in a borehole in the geologic mass of the mine passage; a tapering surface at the opposite end portion of said support member, the tapering surface being spaced from contact with the borehole and diverging away from the opening to the borehole; and a support plate positioned to be free of contact with the borehole and having an opening surrounding and initially engaged with the small end of said tapering surface and presenting a surface area surrounding said opening to the borehole in supporting engagement with the geologic mass to receive the reaction of the geologic mass to the deformation of the mine passage, said tapering surface and said opening in said support plate cooperating in response to tensile strain in said support member to stabilize the geologic mass by relative movement of said support plate opening along said tapering surface to hold substantially constant the restraint to movement of the geologic mass axially of the support member.

2. The yieldable mine support fixture according to claim 1, wherein said opening in said support plate is circumferentially flawed by interruptions in the periphery of said opening.

3. The yieldable mine support fixture according to claim 1 wherein said tapering surface divergence varies from about 1° to about 15° for developing a controlled movement of said support plate.

4. The yieldable mine support fixture according to claim 1, wherein said tapering surface diverges at a substantially constant angle of 5° for developing a controlled movement of said support plate.

5. A yieldable mine support fixture for use in stabilizing the geologic mass in a mine passage, said fixture being disposed in a borehole and comprising: a support member having a first end portion anchored in a borehole and a second end adjacent the mine passage; a flange formation at said second end; elongated resistance means on said support member spaced from the borehole and being adjacent said flange formation having a surface which, from a zone of origin spaced from said flange formation, enlarges circumferentially as it extends toward said flange formation; and a mine support plate free of contact with the borehole and having an opening initially surrounding and engaged with said resistance means adjacent its zone of origin, said support plate being movable axially along said elongated resistance means to yield to the load imposed axially thereon by the geologic mass, whereby said support plate opening and resistance means cooperate to impose a progressively increasing resistance to movement of the geologic mass axially relative to said support member.

6. The yieldable mine support fixture according to claim 5 wherein said expanding circumferential surface of said elongated resistance means is a cone having a slope of from 5° to 8° for developing a controlled movement of said support plate.

7. The yieldable mine support fixture according to claim 5 wherein said elongated resistance means is a sleeve carried on said support member by said flange.

8. The yieldable mine support fixture according to claim 5 wherein said support plate opening is flawed by interruptions in the periphery of said plate opening, said interruptions cooperating with said elongated resistance means for varying the rate of yielding of said plate during movement of said plate along said elongated resistance means.

* * * * *